United States Patent [19]

Skaggs

[11] 4,417,684

[45] Nov. 29, 1983

[54] PARTITION DEVICE

[75] Inventor: Boyd T. Skaggs, Louisville, Ky.

[73] Assignee: Container Corporation of America, Chicago, Ill.

[21] Appl. No.: 466,871

[22] Filed: Feb. 16, 1983

[51] Int. Cl.[3] ..... B65D 5/48

[52] U.S. Cl. ..... 229/15; 229/27

[58] Field of Search ..... 229/15, 27, 28 R

[56] References Cited

U.S. PATENT DOCUMENTS

| | | | |
|---|---|---|---|
| 3,363,824 | 1/1968 | Murata | 229/27 |
| 3,982,684 | 9/1976 | David | 229/15 |
| 4,120,442 | 10/1978 | Skaggs | 229/15 |
| 4,130,235 | 12/1978 | Killy | 229/15 |
| 4,155,501 | 5/1979 | Young | 229/15 |
| 4,157,156 | 6/1979 | Skaggs | 229/15 |
| 4,171,762 | 10/1979 | Matthews | 229/15 |
| 4,226,357 | 10/1980 | Martin | 229/15 |
| 4,249,691 | 2/1981 | Gardner | 229/15 |
| 4,280,650 | 7/1981 | Gardner | 229/15 |

*Primary Examiner*—Herbert F. Ross

*Attorney, Agent, or Firm*—Richard W. Carpenter; Davis Chin

[57] ABSTRACT

An inner packing device for forming a plurality of cells within an outer container and including side panels, end panels, center panels, and transverse panels joined to the center panel and extending therefrom through the side panels.

3 Claims, 8 Drawing Figures

PARTITION DEVICE

BACKGROUND OF THE INVENTION

1. Field of the Invention

This invention relates to inner packing devices and more particularly to a one-piece paperboard partition device adapted to be used within an outer container or wrapper to form a plurality of cells therewith.

2. Description of the Prior Art

A prior art search in the United States Patent and Trademark Office directed to the subject matter of this application disclosed the following U.S. Pat. Nos. 3,871,569; 3,963,171; 4,226,357; 4,272,008.

None of the prior art patents uncovered in the search discloses a one-piece, paperboard, inner partition device which includes opposed side panels, opposed end panels, center panels, and transverse panels cut from and foldably joined to the center panels and extending outwardly through slots in the side panels to form a partition structure.

SUMMARY OF THE INVENTION

An object of the present invention is to provide a one-piece inner packing device for use as a partition within an outer container or wrapper to form a plurality of cells therewith.

A more specific object of the invention is the provision of a collapsible, one-piece partition device formed of paperboard which may be easily assembled by hand from a flat blank.

A more specific object of the invention is the provision of a partition device of the type described which includes a pair of opposed side panels, pairs of opposed end panels, and center panels joined to the end panels and having cut therefrom and foldably joined thereto transverse panels which extend outwardly toward and beyond the side panels to form a partition structure.

These and other objects of the invention will be apparent from an examination of the following description and drawings.

It will be understood that, for purposes of clarity, certain elements have been intentionally omitted from certain views where they are believed to be illustrated to better advantage in other views.

DESCRIPTION OF THE PREFERRED EMBODIMENT

Figure 1:
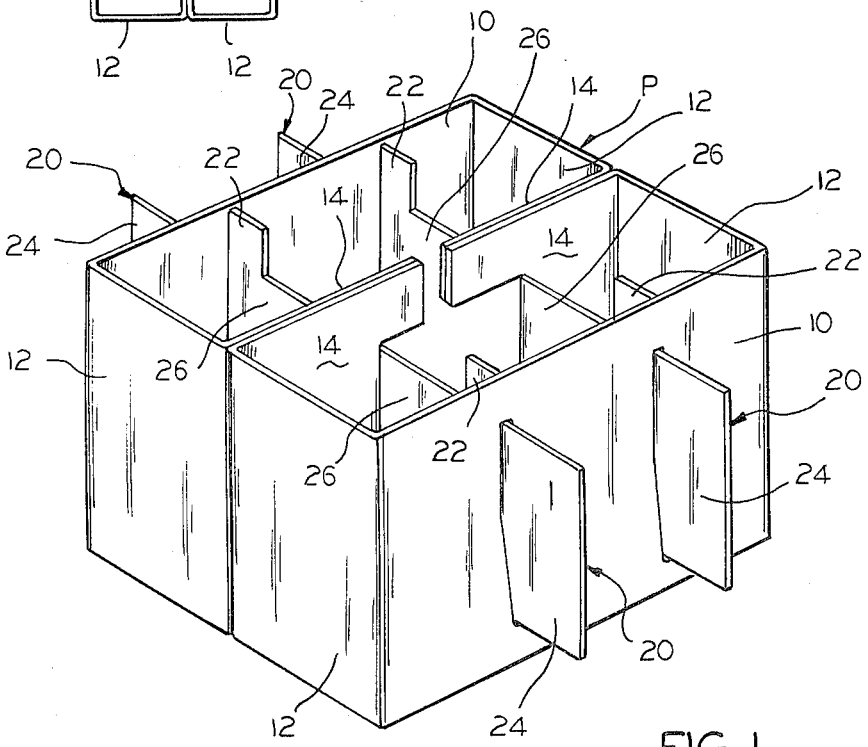
FIG. 1 is a perspective view of a partition device employing features of the invention, as shown in the assembled condition.
Figure 2:
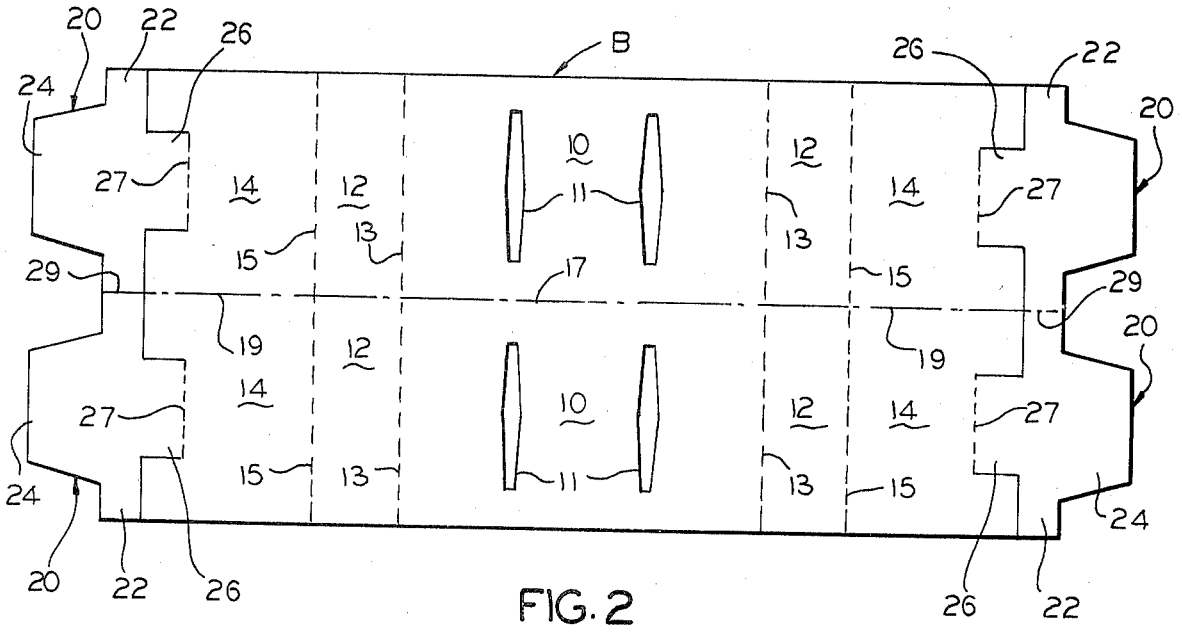
FIG. 2 is a plan view of a blank of foldable sheet material from which the partition device illustrated in FIG. 1 may be formed.

Referring now to the drawings for a better understanding of the invention, it will be seen that the partition device, indicated generally at P in FIG. 1, may be formed from a unitary blank B of foldable sheet material illustrated in FIG. 2.

Blank B is an elongated sheet of material, such as paperboard, and is divided into a pair of identical sections each of which includes a centrally located side panel 10 having a pair of end panels 12 foldably joined on fold lines 13 to opposite end edges thereof.

Foldably joined to opposite edges of each end panel 12 on fold line 15 are center panel sections 14 each of which in turn has foldably joined to its opposite edge, on fold line 27, a transverse panel indicated generally at 20.

Still referring to FIG. 2 it will be seen that side panels 10 and end panels 12 of the respective sections of the blanks are separated from each other by a cut line 17, and transverse panels 20 are separated from each other by cut lines 29. At the same time center panel sections 14 are foldably joined to each other along fold lines 19.

It will be noted that each of the transverse panels 20 is constructed in the form of a cross with a center upright or vertical portion 22 and a pair of side wings or lateral portions 24 and 26 extending outwardly from opposite sides thereof with each lateral portion 26 being foldably joined to adjacent center panel section 14 on the previously mentioned fold line 27.

Figure 6:
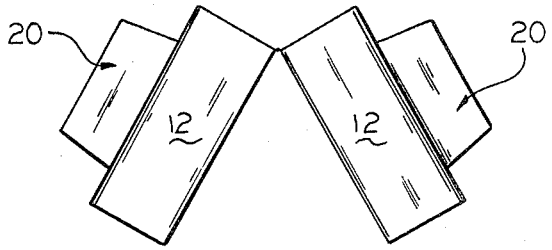
FIG. 6 is a view similar to FIG. 4, but illustrating the manner in which the two sections of the device are folded together in side-by-side relation.
Figure 7:
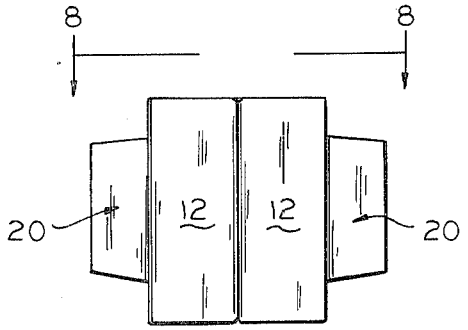
FIG. 7 is an end elevational view of the structure in its assembled condition.
Figure 8:
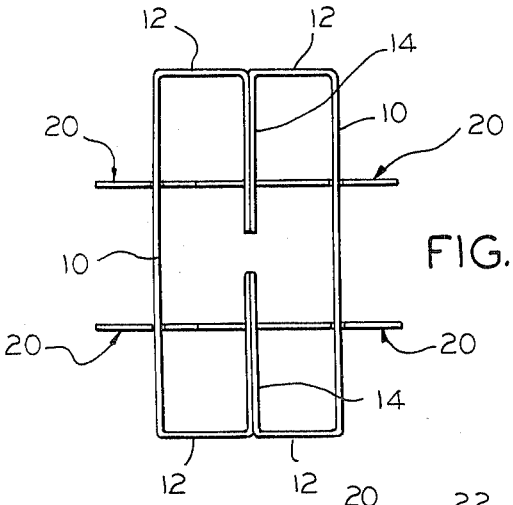
FIG. 8 is a top plan view of the structure taken on line 8—8 of FIG. 7.
Figure 3:
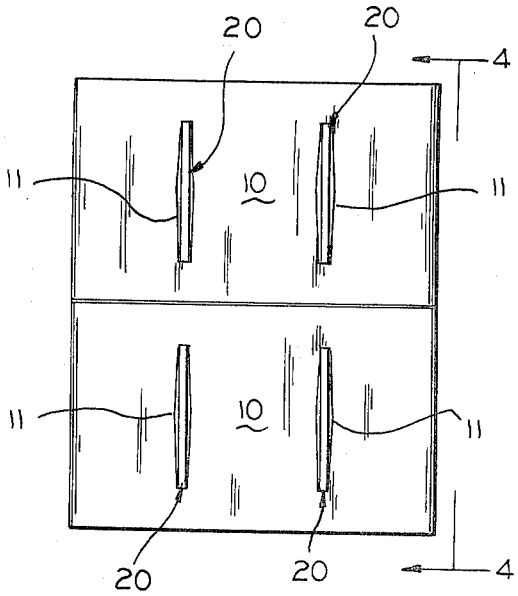
FIG. 3 is a fragmentary side elevational view of the partially assembled structure illustrating one step in the assembly of the partition from the blank.
Figure 5:
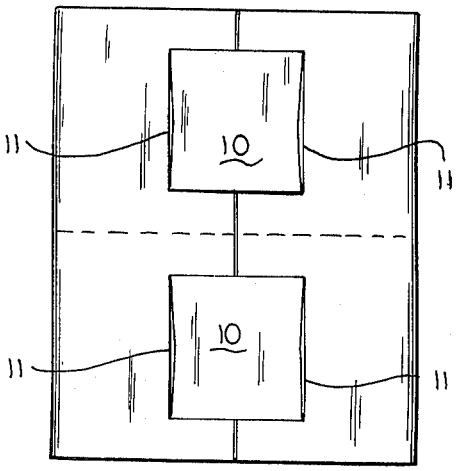
FIG. 5 is a view of the structure illustrated in FIG. 3, but as seen from the opposite side thereof.
Figure 4:
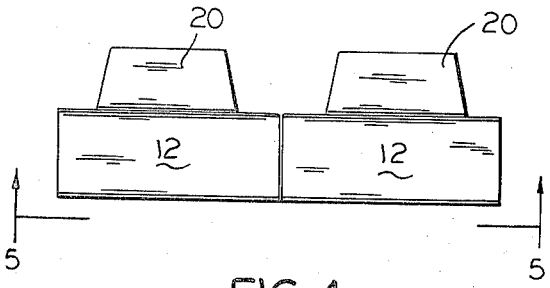
FIG. 4 is an end elevational view taken on line 4—4 of FIG. 3.

In assemblying the structure the transverse panels, center panel sections, and end panels are folded at right angles to side panels 10. Center panel sections 14 and attached transverse panels 20 are then folded at right angles to end panels 12 so as to lie in face-to-face relation with each other, at best seen in FIGS. 1 and 8. Transverse panels 20 are then folded at right angles to their respective center panel sections 14, with the lateral portions 24 projecting through the slots 11 in the respective side panels 10 and outwardly beyond the side panels, as best seen in FIGS. 3, 4 and 5. At this point the blank sections are folded at 180° on fold lines 19, so that side panels 10 are brought in face-to-face relationship to form the structure illustrated in FIGS. 1, 7, and 8.

Thus, it will be appreciated that the novel arrangement for the partition device provides one which is relatively inexpensive to produce and which may be manually assembled very quickly.

What is claimed is:

1. An inner packing device for use within an outer container or wrapper to form therewith twelve cells, said structure being formed from a unitary blank of foldable sheet material, such as paperboard, to provide:

(a) a pair of opposed side panels disposed parallel to, but spaced from, each other and each presenting a pair of vertical slots extending therethrough;

(b) opposed pairs of end panels foldably joined at outer edges to end edges of respective side panels and extending inwardly therefrom and generally normal thereto;

(c) opposed pairs of center panel sections foldably joined at end edges to inner edges of respective end panels;

(d) each pair of said center panel sections being disposed in face-to-face relation, having corresponding edges foldably joined to each other, and being positioned in end-to-end, co-planar relation with respective center panel sections of the other of said pairs to form a center panel structure disposed between and parallel to, but spaced from, said side panels;

(e) opposed pairs of generally cruciformly-shaped transverse panels extending parallel to said end wall panels, but spaced therefrom and from each other;

(f) each of said transverse panels including a center portion with a pair of integral inboard and outboard side portions extending therefrom;

(g) said inboard side portion being formed from material cut from and being foldably joined to a related center panel section adjacent a free end thereof on a vertical fold line;

(h) said outboard side portion being disposed to extend through a slot in a related side panel and outboardly therebeyond.

2. An inner packing device for use within an outer container or wrapper to form therewith twelve cells, said structure being formed from a unitary blank of foldable sheet material, such as paperboard, to provide:

(a) a pair of opposed side panels dispose parallel to, but spaced from, each other and each presenting a pair of vertical slots extending therethrough;

(b) opposed pairs of end panels foldably joined at outer edges to end edges of respective side panels and extending inwardly therefrom and generally normal thereto;

(c) opposed pairs of center panel sections foldably joined at end edges to inner edges of respective end panels;

(d) each pair of said center panel sections being disposed in face-to-face relation, having corresponding edges foldably joined to each other, and being positioned in end-to-end, co-planar relation with respective center panel sections of the other of said pairs to form a center panel structure disposed between and parallel to, but spaced from, said side panels;

(e) opposed pairs of generally cruciformly-shaped transverse panels extending parallel to said end wall panels, but spaced therefrom and from each other;

(f) each of said transverse panels being foldably joined to a related center panel section adjacent a free end thereof on a vertical fold line and being disposed to extend through a slot in a related side panel and outboardly therebeyond.

3. A unitary blank of foldably sheet material, such as paperboard, which is cut and scored to provide an inner packing device for use within an outer container or wrapper to form therewith twelve cells, said blank comprising;

(a) a pair of similar elongated blank sections disposed in side-by-side relation;

(b) each section including;

(i) a centrally disposed side panel presenting a pair of closed slots therein;

(ii) a pair of end panels foldably joined to opposite edges of said side panel;

(iii) a pair of center panel sections foldably joined to adjacent edges of respective side panels;

(iv) a pair of cruciformly-shaped transverse panels foldably joined to adjacent edges of respective center panel sections;

(c) corresponding center panel sections of respective blank sections being foldably joined to each other;

(d) said corresponding side, end, and transverse panels of respective blank sections being free from attachment to each other.

* * * * *